US011355065B2

(12) United States Patent
Wu et al.

(10) Patent No.: US 11,355,065 B2
(45) Date of Patent: Jun. 7, 2022

(54) PIXEL COMPENSATION DRIVING CIRCUIT, DRIVING METHOD THEREOF, AND DISPLAY PANEL

(71) Applicant: SHENZHEN CHINA STAR OPTOELECTRONICS SEMICONDUCTOR DISPLAY TECHNOLOGY CO., LTD., Guangdong (CN)

(72) Inventors: Zhen Wu, Shenzhen (CN); Zhenling Wang, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 235 days.

(21) Appl. No.: 16/764,639

(22) PCT Filed: Apr. 21, 2020

(86) PCT No.: PCT/CN2020/085850
§ 371 (c)(1),
(2) Date: May 15, 2020

(87) PCT Pub. No.: WO2021/203475
PCT Pub. Date: Oct. 14, 2021

(65) Prior Publication Data

US 2022/0114964 A1 Apr. 14, 2022

(30) Foreign Application Priority Data

Apr. 9, 2020 (CN) ..... 202010273198.6

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01); *G09G 3/3233* (2013.01); *G09G 3/3266* (2013.01)

(58) Field of Classification Search
CPC ... G09G 3/3258; G09G 3/3233; G09G 3/3266
See application file for complete search history.

(56) References Cited

U.S. PATENT DOCUMENTS 9,076,387 B1 7/2015 Lee et al.
2014/0176409 A1* 6/2014 Kim ..... G09G 3/3233 345/92

(Continued)

FOREIGN PATENT DOCUMENTS

CN 101430862 A 5/2009
CN 203311812 U 11/2013

(Continued)

*Primary Examiner* — Stacy Khoo
(74) *Attorney, Agent, or Firm* — Benesch, Friedlander, Coplan & Aronoff LLP

(57) ABSTRACT

The present disclosure provides a pixel compensation driving circuit, which compensates an actual threshold voltage of a driving transistor, and finally makes current flowing through a light-emitting element independent from the actual threshold voltage of the driving transistor, thereby eliminating a drift of the actual threshold voltage of the driving transistor which causes uneven display of a display device, and improving display effect of a screen. The present disclosure also provides a pixel compensation driving method for driving the pixel compensation driving circuit, and a display device including the pixel compensation driving circuit.

20 Claims, 4 Drawing Sheets

(56) References Cited

U.S. PATENT DOCUMENTS

| | | | |
|---|---|---|---|
| 2015/0123953 | A1 | 5/2015 | Shim et al. |
| 2016/0189629 | A1 | 6/2016 | Jin |
| 2018/0182287 | A1 | 6/2018 | Park et al. |
| 2019/0019456 | A1 | 1/2019 | Chen |
| 2019/0189038 | A1 | 6/2019 | Park |

FOREIGN PATENT DOCUMENTS

| | | | |
|---|---|---|---|
| CN | 104637440 | A | 5/2015 |
| CN | 104700772 | A | 6/2015 |
| CN | 105321446 | A | 2/2016 |
| CN | 105741759 | A | 7/2016 |
| CN | 107230453 | A | 10/2017 |
| CN | 108231004 | A | 6/2018 |
| CN | 109697944 | A | 4/2019 |
| CN | 110827763 | A | 2/2020 |
| KR | 20190059674 | A | 5/2019 |

* cited by examiner

PIXEL COMPENSATION DRIVING CIRCUIT, DRIVING METHOD THEREOF, AND DISPLAY PANEL

FIELD OF INVENTION

The present disclosure relates to the field of display technology, and more particularly, to a pixel compensation driving circuit, a driving method thereof, and a display panel.

BACKGROUND OF INVENTION

Organic light-emitting diode (OLED) display devices are a type of display device that use organic light-emitting materials driven by electric field to emit light by carrier injection and recombination, and have advantages of self-luminosity, wide viewing angles, high contrast, low electricity consumption, and fast response times.

However, due to limitations of manufacturing process, there are certain differences in electrical characteristics of driving transistors of each pixel of current OLED display devices, and the driving transistors are unstable during operation and are easily affected by factors such as temperature and light, thereby causing a characteristic drift. A difference between the electrical characteristics of the driving transistors in space and in time causes a threshold voltage drift of the driving transistors, resulting in a problem of uneven display of the OLED display devices.

SUMMARY OF INVENTION

The present disclosure provides a pixel compensation driving circuit, a driving method thereof, and a display device to solve the technical problem of uneven display of the current OLED display device.

In a first aspect, the present disclosure provides pixel compensation driving circuit, wherein the pixel compensation driving circuit comprises: a driving transistor DT, a first transistor T1, a second transistor T2, a third transistor T3, a fourth transistor T4, a storage capacitor, a light-emitting element, a first switch S1, a second switch S2, and a compensation unit;

a control terminal of the driving transistor DT is connected to a first node G, a first terminal of the driving transistor DT is connected to a second node S, and a second terminal of the driving transistor DT is connected to a third node Q;

a control terminal of the first transistor T1 is connected to a first scan signal Scan1, a first terminal of the first transistor T1 is connected to a data line and a first terminal of the compensation unit, a second terminal of the first transistor T1 is connected to the first node G;

a control terminal of the second transistor T2 is connected to a second scan signal Scan2, a first terminal of the second transistor T2 is connected to the second node S, and a second terminal of the second transistor T2 is connected to a first terminal of the first switch S1 and a first terminal of the second switch S2;

a control terminal of the third transistor T3 is connected to a third scan signal Scan3, a first terminal of the third transistor T3 is connected to a negative power supply voltage VSS, and a second terminal of the third transistor T3 is connected to the second node S;

a control terminal of the fourth transistor T4 is connected to a fourth scan signal Scan4, a first terminal of the fourth transistor T4 is connected to the third node Q, and a second terminal of the fourth transistor T4 is connected to a positive power supply voltage VDD;

a first terminal of the storage capacitor is connected to the first node G, and a second terminal of the storage capacitor is connected to the second node S;

a first terminal of the light-emitting element is connected to the positive power supply voltage VDD, and a second terminal of the light-emitting element is connected to the third node Q;

a second terminal of the first switch S1 is connected to an initialization voltage Vi;

a second terminal of the second switch S2 is connected to a second terminal of the compensation unit;

the compensation unit is configured to detect and store an initial threshold voltage of the driving transistor DT, so that the pixel compensation driving circuit obtains a superimposing data voltage by superimposing the initial threshold voltage and a data voltage output from the data line to compensate an actual threshold voltage of the driving transistor DT.

In some embodiments, the pixel compensation driving circuit further detects and stores a mobility of the driving transistor DT according to the superimposing data voltage.

In some embodiments, the driving transistor DT, the first transistor T1, the second transistor T2, the third transistor T3, and the fourth transistor T4 are N-type thin film transistors.

In some embodiments, all the driving transistor DT, the first transistor T1, the second transistor T2, the third transistor T3, and the fourth transistor T4 are low temperature polysilicon thin film transistors, oxide semiconductor thin film transistors, or amorphous silicon thin film transistors.

In some embodiments, the light-emitting element is an organic light-emitting diode.

In some embodiments, a first terminal of the light-emitting element is an anode terminal, and a second terminal of the light-emitting element is a cathode terminal.

In some embodiments, the first scan signal Scan1, the second scan signal Scan2, the third scan signal Scan3, and the fourth scan signal Scan4 are provided by a timing controller.

In a second aspect, the present disclosure provides a pixel compensation driving method for driving a pixel compensation driving circuit, wherein the pixel compensation driving circuit comprises a driving transistor DT, a first transistor T1, a second transistor T2, a third transistor T3, a fourth transistor T4, a storage capacitor, a light-emitting element, a first switch S1, a second switch S2, and a compensation unit;

a control terminal of the driving transistor DT is connected to a first node G, a first terminal of the driving transistor DT is connected to a second node S, and a second terminal of the driving transistor DT is connected to a third node Q;

a control terminal of the first transistor T1 is connected to a first scan signal Scan1, a first terminal of the first transistor T1 is connected to a data line and a first terminal of the compensation unit, a second terminal of the first transistor T1 is connected to the first node G;

a control terminal of the second transistor T2 is connected to a second scan signal Scan2, a first terminal of the second transistor T2 is connected to the second node S, and a second terminal of the second transistor T2 is connected to a first terminal of the first switch S1 and a first terminal of the second switch S2;

a control terminal of the third transistor T3 is connected to a third scan signal Scan3, a first terminal of the third transistor T3 is connected to a negative power supply voltage VSS, and a second terminal of the third transistor T3 is connected to the second node S;

a control terminal of the fourth transistor T4 is connected to a fourth scan signal Scan4, a first terminal of the fourth transistor T4 is connected to the third node Q, and a second terminal of the fourth transistor T4 is connected to a positive power supply voltage VDD;

a first terminal of the storage capacitor is connected to the first node G, and a second terminal of the storage capacitor is connected to the second node S;

a first terminal of the light-emitting element is connected to the positive power supply voltage VDD, and a second terminal of the light-emitting element is connected to the third node Q;

a second terminal of the first switch S1 is connected to an initialization voltage Vi;

a second terminal of the second switch S2 is connected to a second terminal of the compensation unit;

the compensation unit is configured to detect and store an initial threshold voltage of the driving transistor DT, so that the pixel compensation driving circuit obtains a superimposing data voltage by superimposing the initial threshold voltage and a data voltage output from the data line to compensate an actual threshold voltage of the driving transistor DT.

the pixel compensation driving method comprising the following steps:

step S1, during shutdown, the compensation unit detects and stores the initial threshold voltage of the driving transistor DT;

step S2, during operation, the pixel compensation driving circuit obtains the superimposing data voltage by superimposing the initial threshold voltage and the data voltage output from the data line to compensate an actual threshold voltage of the driving transistor DT within each frame time to compensate the actual threshold voltage.

In some embodiments, after the step S2, the pixel compensation driving method further comprising:

step S3, during operation, the pixel compensation driving circuit detects and stores a mobility of the driving transistor DT within each frame time according to the superimposing data voltage.

In some embodiments, the step S2 further comprising a reset phase, a detection phase, a voltage writing phase, and a light-emitting phase;

during the reset phase, the first scan signal Scan1, the second scan signal Scan2, and the fourth scan signal Scan4 provide high electrical potential, the third scan signal Scan3 provide a low electrical potential, the first switch S1 is closed, and the second switch S2 is open; the driving transistor DT, the first transistor T1, the second transistor T2, and the fourth transistor T4 are turned on, the third transistor T3 is turned off, the second terminal of the second transistor T2 is connected to the initialization voltage VI, and the first terminal of the first transistor T1 is connected to a reference voltage;

during the detection phase, the first scan signal Scan1 and the fourth scan signal Scan4 provide the high electrical potential, and the second scan signal Scan2 and third scan signal Scan3 provide the low electrical potential, the first switch S1 and the second switch S2 are disconnected; the driving transistor DT, the first transistor T1, and the fourth transistor T4 are turned on, the second transistor T2 and the third transistor T3 are turned off, and the first terminal of the first transistor T1 is connected to the reference voltage;

during the voltage writing phase, the first scan signal Scan1 and the third scan signal Scan3 provide the high electrical potential, and the second scan signal Scan2 and the fourth scan signal Scan4 provide the low electrical potential, the first switch S1 and the second switch S2 are disconnected; the driving transistor DT, the first transistor T1 and the third transistor T3 are turned on, the second transistor T2 and the fourth transistor T4 are turned off, and the first terminal of the first transistor T1 is connected to the superimposing data voltage; and during the light-emitting phase, the third scan signal Scan3 provides a high electrical potential, and the first scan signal Scan1, the second scan signal Scan2, and the fourth scan signal Scan4 provide the low electrical potential, the first switch S1 and the second switch S2 are disconnected; the driving transistor DT and the third transistor T3 are turned on, and the first transistor T1, the second transistor T2, and the fourth transistor T4 are turned off, and the first terminal of the first transistor T1 is connected to the reference voltage.

In some embodiments, the step S3 further comprising a first mobility detection phase, a second mobility detection phase, and a third mobility detection phase;

during the first mobility detection phase, the first scan signal Scan1, the second scan signal Scan2 and the third scan signal Scan3 provide the high electrical potential, and the fourth scan signal Scan4 provides the low electrical potential, the first switch S1 is closed, and the second switch S2 is open; the driving transistor DT, the first transistor T1, the second transistor T2 and the third transistor T3 are turned on, the fourth transistor T4 is turned off, the second terminal of the second transistor T2 is connected to the initialization voltage Vi, and the first terminal of the first transistor T1 is connected to the superimposing data voltage;

during the second mobility detection phase, the second scan signal Scan2 and the third scan signal Scan3 provide the high electrical potential, the first scan signal Scan1 and the fourth scan signal Scan4 provide the low electrical potential, the first switch S1 and the second switch S2 are disconnected; the driving transistor DT, the second transistor T2, and the third transistor T3 are turned on, the first transistor T1 and the fourth transistor T4 are turned off, and the first terminal of the first transistor T1 is connected to the reference voltage; and during the third mobility detection phase, the second scan signal Scan2 and the third scan signal Scan3 provide the high electrical potential, the first scan signal Scan1 and the fourth scan signal Scan4 provide the low electrical potential, the first switch S1 is open, the second switch S2 is closed, the driving transistor DT, the second transistor T2, and the third transistor T3 are turned on, the first transistor T1 and the fourth transistor T4 are turned off, and the second terminal of the second transistor T2 is connected to the second terminal of the compensation unit, and the first terminal of the first transistor T1 is connected to the reference voltage.

In some embodiments, the step S1 comprising a first initial threshold voltage detection phase and a second initial threshold voltage detection phase;

during the first initial threshold voltage detection phase, the first scan signal Scan1, the second scan signal Scan2, and the third scan signal Scan3 are provided high electrical potential, the fourth scan signal Scan4 provide the low electrical potential, the first switch S1 is closed, and the second switch S2 is open; the driving transistor DT, the first transistor T1, the second transistor T2 and the third transistor T3 are turned on, the fourth transistor T4 is turned off, the second terminal of the second transistor T2 is connected to the initialization voltage Vi, the first terminal of the first transistor T1 is connected to the data voltage; and during the second initial threshold voltage detection phase, the first scan signal Scan1, the second scan signal Scan2, and the third scan signal Scan3 provide the high electrical potential, and the fourth scan signal Scan4 provide the low electrical potential, the first switch S1 is open, and the second switch S2 is closed; the driving transistor DT, the first transistor T1, the second transistor T2 and the third transistor T3 are turned on, the fourth transistor T4 is turned off, and the second terminal of the second transistor T2 is connected to the second terminal of the compensation unit, the first terminal of the first transistor T1 is connected to the data voltage.

In a third aspect, the present disclosure provides a display device including a pixel compensation driving circuit comprising: a driving transistor DT, a first transistor T1, a second transistor T2, a third transistor T3, a fourth transistor T4, a storage capacitor, a light-emitting element, a first switch S1, a second switch S2, and a compensation unit;

a control terminal of the driving transistor DT is connected to a first node G, a first terminal of the driving transistor DT is connected to a second node S, and a second terminal of the driving transistor DT is connected to a third node Q;

a control terminal of the first transistor T1 is connected to a first scan signal Scan1, a first terminal of the first transistor T1 is connected to a data line and a first terminal of the compensation unit, a second terminal of the first transistor T1 is connected to the first node G;

a control terminal of the second transistor T2 is connected to a second scan signal Scan2, a first terminal of the second transistor T2 is connected to the second node S, and a second terminal of the second transistor T2 is connected to a first terminal of the first switch S1 and a first terminal of the second switch S2;

a control terminal of the third transistor T3 is connected to a third scan signal Scan3, a first terminal of the third transistor T3 is connected to a negative power supply voltage VSS, and a second terminal of the third transistor T3 is connected to the second node S;

a control terminal of the fourth transistor T4 is connected to a fourth scan signal Scan4, a first terminal of the fourth transistor T4 is connected to the third node Q, and a second terminal of the fourth transistor T4 is connected to a positive power supply voltage VDD;

a first terminal of the storage capacitor is connected to the first node G, and a second terminal of the storage capacitor is connected to the second node S;

a first terminal of the light-emitting element is connected to the positive power supply voltage VDD, and a second terminal of the light-emitting element is connected to the third node Q;

a second terminal of the first switch S1 is connected to an initialization voltage VI;

a second terminal of the second switch S2 is connected to a second terminal of the compensation unit;

the compensation unit is configured to detect and store an initial threshold voltage of the driving transistor DT, so that the pixel compensation driving circuit obtains a superimposing data voltage by superimposing the initial threshold voltage and a data voltage output from the data line to compensate an actual threshold voltage of the driving transistor DT.

In some embodiments, the pixel compensation driving circuit further detects and stores a mobility of the driving transistor DT according to the superimposing data voltage.

In some embodiments, the driving transistor DT, the first transistor T1, the second transistor T2, the third transistor T3, and the fourth transistor T4 are N-type thin film transistors.

In some embodiments, all the driving transistor DT, the first transistor T1, the second transistor T2, the third transistor T3, and the fourth transistor T4 are low temperature polysilicon thin film transistors, oxide semiconductor thin film transistors, or amorphous silicon thin film transistors.

In some embodiments, the light-emitting element is an organic light-emitting diode.

In some embodiments, the first terminal of the light-emitting element is an anode terminal, and the second terminal of the light-emitting element is a cathode terminal.

In some embodiments, the first scan signal Scan1, the second scan signal Scan2, the third scan signal Scan3, and the fourth scan signal Scan4 are provided by a timing controller.

In some embodiments, the display device is an active matrix organic light-emitting diode display device.

The pixel compensation driving circuit provided by the present disclosure includes a driving transistor, a first transistor, a second transistor, a third transistor, a fourth transistor, a storage capacitor, a light-emitting element, a first switch, a second switch, and a compensation unit, wherein the compensation unit is configured to detect and store the initial threshold voltage of the driving transistor during each shutdown period of the display device, so that the pixel compensation driving circuit obtains the superimposing data voltage by superimposing the initial threshold voltage and the data voltage output from the data line during the next power-on period of the display device, to compensate the actual threshold voltage of the driving transistor. Finally, the current is made to flow through the light-emitting element independent from the actual threshold voltage of the driving transistor, thereby eliminating the drift of the actual threshold voltage of the driving transistor which causes uneven display of the display device, and improving display effect of the screen.

DETAILED DESCRIPTION OF PREFERRED EMBODIMENTS

In order to make the objectives, technical solutions and effects of the present disclosure clearer and more specific, the present disclosure will be described in further detail below with reference to the accompanying figures and embodiments. The specific embodiments described herein are only used to explain the present disclosure and are not intended to limit the present disclosure.

Figure 1:
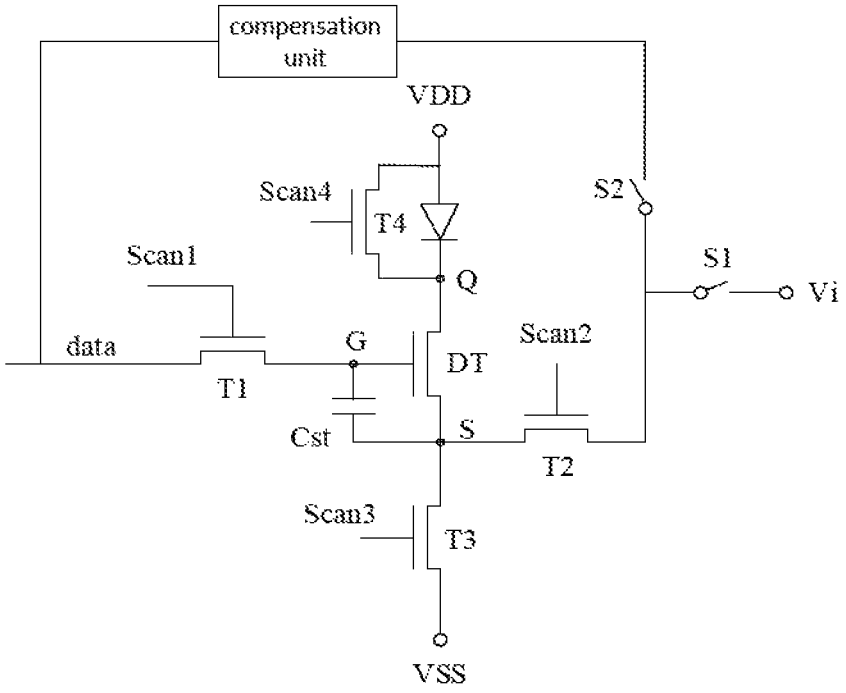
FIG. 1 is a circuit diagram of a pixel compensation driving circuit according to one embodiment of the present disclosure.

One embodiment of the present disclosure provides a pixel compensation driving circuit. FIG. 1 is a circuit diagram of a pixel compensation driving circuit according to one embodiment of the present disclosure. As shown in FIG. 1, the pixel compensation driving circuit adopts a 5T1C structure, including: a driving transistor DT, a first transistor T1, a second transistor T2, a third transistor T3, a fourth transistor T4, a storage capacitor Cst, a light-emitting element, a first switch S1, a second switch S2, and a compensation unit.

A control terminal of the driving transistor DT is connected to a first node G, a first terminal of the driving transistor DT is connected to a second node S, and a second terminal of the driving transistor DT is connected to a third node Q. A control terminal of the first transistor T1 is connected to a first scan signal Scan1, a first terminal of the first transistor T1 is connected to a data line and a first terminal of the compensation unit, and a second terminal of the first transistor T1 is connected to the first node G A control terminal of the second transistor T2 is connected to a second scan signal Scan2, a first terminal of the second transistor T2 is connected to the second node S, and a second terminal of the second transistor T2 is connected to a first terminal of the first switch S1 and a first terminal of the second switch S2. A control terminal of the third transistor T3 is connected to a third scan signal Scan3, a first terminal of the third transistor T3 is connected to a negative power supply voltage VSS, and a second terminal of the third transistor T3 is connected to the second node S. A control terminal of the fourth transistor T4 is connected to a fourth scan signal Scan4, a first terminal of the fourth transistor T4 is connected to the third node Q, and a second terminal of the fourth transistor T4 is connected to a positive power supply voltage VDD. A first terminal of the storage capacitor Cst is connected to the first node G, and a second terminal of the storage capacitor Cst is connected to the second node S. A first terminal of the light-emitting element is connected to the positive power supply voltage VDD, and a second terminal of the light-emitting element is connected to the third node Q. A second terminal of the first switch S1 is connected to an initialization voltage Vi. A second terminal of the second switch S2 is connected to a second terminal of the compensation unit.

The compensation unit is configured to detect and store an initial threshold voltage of the driving transistor DT, so that the pixel compensation driving circuit obtains a superimposing data voltage by superimposing the initial threshold voltage and a data voltage output from the data line to compensate an actual threshold voltage of the driving transistor DT.

The pixel compensation driving circuit also detects and stores a mobility of the driving transistor DT according to the superimposing data voltage.

It should be noted that the control terminal, the first terminal, and the second terminal of the transistor in the embodiment of the present disclosure are the gate, source, and drain of the transistor, respectively, and the first terminal and the second terminal can be interchanged.

The light-emitting element is an organic light-emitting diode, the first terminal of the light-emitting element is an anode terminal, and the second terminal is a cathode terminal.

The compensation unit may include an analog-to-digital converter, a current is comparator, a controller, a memory, and a digital-to-analog converter connected in sequence, an input terminal of the analog-to-digital converter is connected to the second terminal of the second switch S2, and an output terminal of the digital-to-analog converter is connected to the first terminal of the first transistor T1. The analog-to-digital converter is configured to digitize the initial threshold voltage of the driving transistor DT output from the second terminal of the second transistor T2, the memory is configured to store the digitized initial threshold voltage, and the digital-to-analog converter is configured to simulate the digitized initial threshold voltage, then input to the first terminal of the first transistor T1.

In one embodiment, the driving transistor DT, the first transistor T1, the second transistor T2, the third transistor T3, and the fourth transistor T4 are N-type thin film transistors.

In one embodiment, all the driving transistor DT, the first transistor T1, the second transistor T2, the third transistor T3, and the fourth transistor T4 are low temperature polysilicon thin film transistors, or oxide semiconductor thin film transistors, or amorphous silicon thin film transistors.

It should be noted that the driving transistor DT, the first transistor T1, the second transistor T2, the third transistor T3, and the fourth transistor T4 in the embodiment of the present disclosure all use the same type of thin film transistor to prevent a difference between different types of thin film transistors from adversely affecting the pixel compensation driving circuit.

In one embodiment, the first scan signal Scan1, the second scan signal Scan2, the third scan signal Scan3, and the fourth scan signal Scan4 are all provided by an external timing controller.

Figure 2:
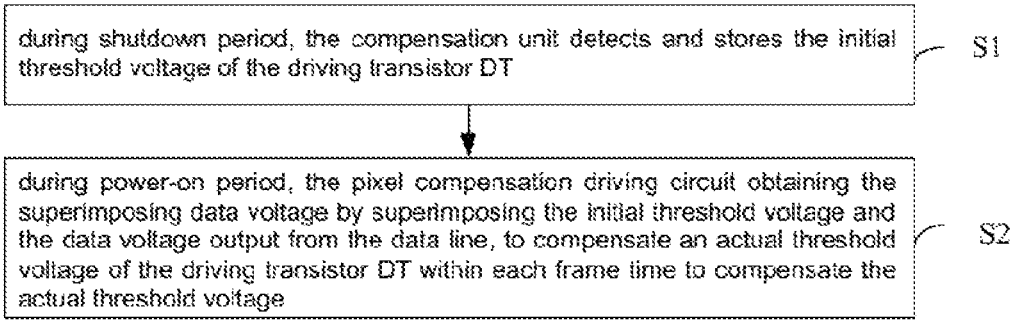
FIG. 2 is a flowchart of a pixel compensation driving method according to one embodiment of the present disclosure.

Embodiments of the present disclosure also provide a pixel compensation driving method for driving the above pixel compensation driving circuit. It can be understood that the display device including the above pixel compensation driving circuit includes a cycle period composed of multiple shutdown periods and multiple power-on periods. FIG. 2 is a flowchart of a pixel compensation driving method according to one embodiment of the present disclosure. As shown in FIG. 2, the pixel compensation driving method includes the following steps:

Step S1, during the shutdown period, the compensation unit detects and stores the initial threshold voltage of the driving transistor DT.

Step S2, during power-on period, the pixel compensation driving circuit obtains the superimposing data voltage by superimposing the initial threshold voltage and the data voltage output from the data line, to compensate an actual threshold voltage of the driving transistor DT within each frame time to compensate the actual threshold voltage.

After step S2, the pixel compensation driving method further includes:

step S3, during power-on period, the pixel compensation driving circuit detects and stores a mobility of the driving transistor DT within each frame time according to the superimposing data voltage.

Specifically, during each frame time of step S2, the operation process that the pixel compensation driving circuit obtains the superimposing data voltage by superimposing the initial threshold voltage and the data output from the data line to compensate the actual threshold voltage of the driving transistor DT including a reset phase, a detection phase, a voltage writing phase, and a light-emitting phase.

Figure 3:
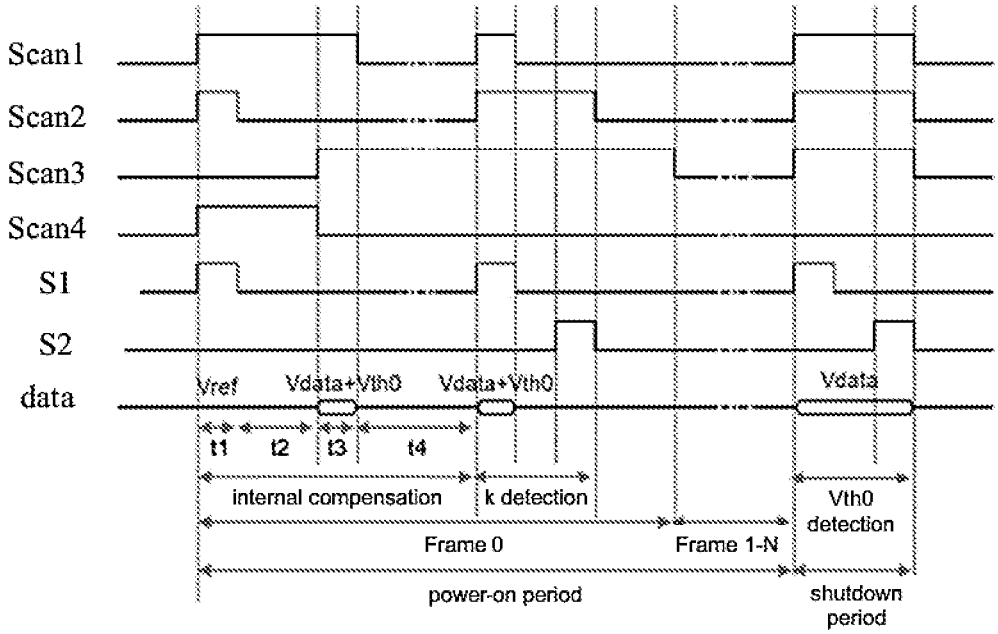
FIG. 3 is a timing diagram of a driving signal of the pixel compensation driving circuit according to one embodiment of the present disclosure.
Figure 4:
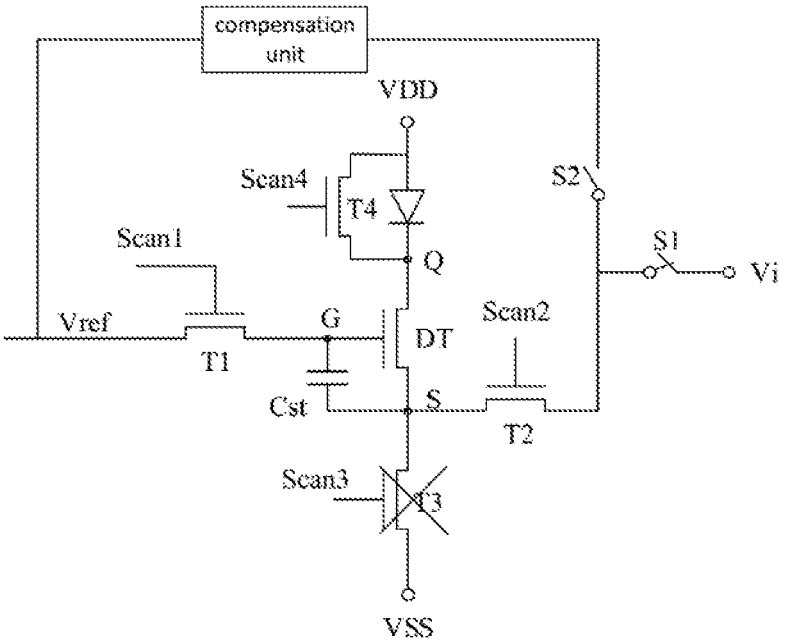
FIG. 4 is a circuit diagram of the pixel compensation driving circuit during a reset phase according to one embodiment of the present disclosure.

FIG. 3 is a timing diagram of a driving signal of the pixel compensation driving circuit according to one embodiment of the present disclosure. FIG. 4 is a circuit diagram of the pixel compensation driving circuit during a reset phase according to one embodiment of the present disclosure. Please refer to FIG. 3 and FIG. 4, during the reset phase t1, the first scan signal Scan1, the second scan signal Scan2, and the fourth scan signal Scan4 provide high electrical potential, the third scan signal Scan3 provide a low electrical potential, the first switch S1 is closed, and the second switch S2 is open. The driving transistor DT, the first transistor T1, the second transistor T2, and the fourth transistor T4 are turned on, the third transistor T3 is turned off, the second terminal of the second transistor T2 is connected to the initialization voltage Vi, and the first terminal of the first transistor T1 is connected to a reference voltage Vref. At the same time, the first node G received the reference voltage Vref, and the second node S received the initialization voltage Vi.

Figure 5:
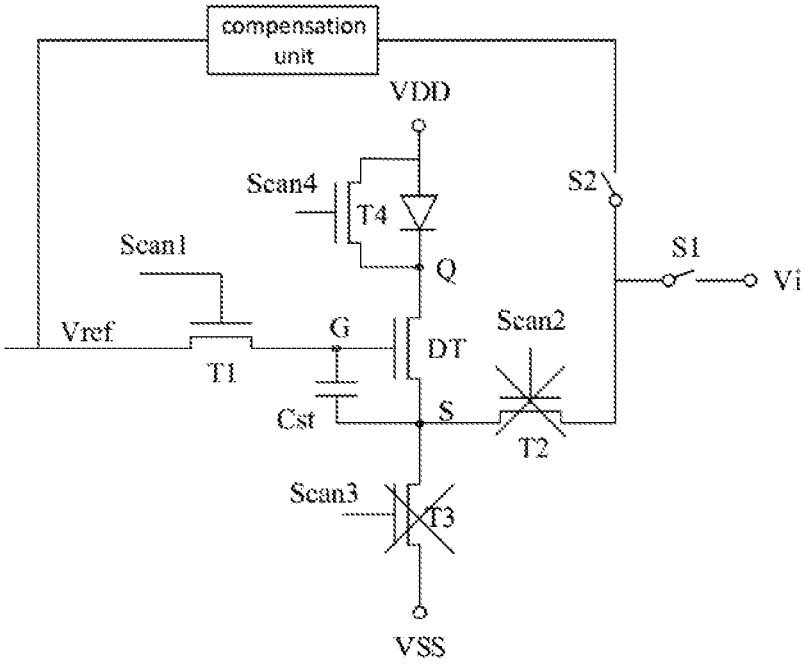
FIG. 5 is a circuit diagram of the pixel compensation driving circuit during a detection phase according to one embodiment of the present disclosure.

FIG. 5 is a circuit diagram of the pixel compensation driving circuit during a detection phase according to one embodiment of the present disclosure. With reference to FIGS. 3 and 5, during the detection phase t2, the first scan signal Scan1 and the fourth scan signal Scan4 provide the high electrical potential, the second scan signal Scan2 and third scan signal Scan3 provide the low electrical potential, the first switch S1 and the second switch S2 are disconnected; the driving transistor DT, the first transistor T1, and the fourth transistor T4 are turned on, the second transistor T2 and the third transistor T3 are turned off, and the first terminal of the first transistor T1 is connected to the reference voltage Vref. At the same time, the first node G receives the reference voltage Vref, the positive power supply voltage VDD charges the second node S, and the voltage of the second node S is raised to Vref-Vth, wherein Vth is the actual threshold voltage of the driving transistor DT during power-on period.

Figure 6:
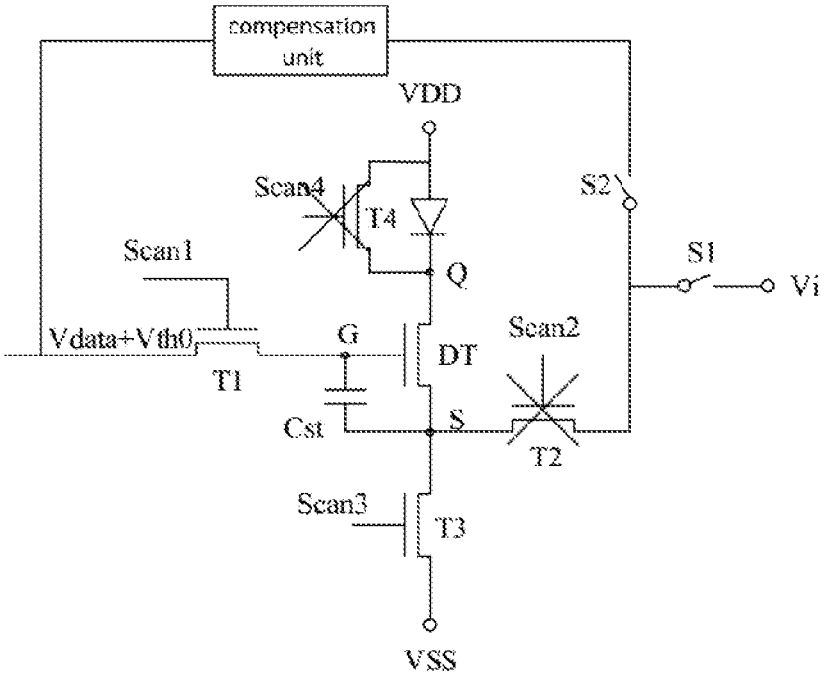
FIG. 6 is a circuit diagram of the pixel compensation driving circuit during a voltage writing phase according to one embodiment of the present disclosure.

FIG. 6 is a circuit diagram of the pixel compensation driving circuit during a voltage writing phase according to one embodiment of the present disclosure. With reference to FIGS. 3 and 6, during the voltage writing phase t3, the first scan signal Scan1 and the third scan signal Scan3 provide the high electrical potential, and the second scan signal Scan2 and the fourth scan signal Scan4 provide the low electrical potential, the first switch S1 and the second switch S2 are disconnected; the driving transistor DT, the first transistor T1, and the third transistor T3 are turned on, the second transistor T2 and the fourth transistor T4 are turned off, and the first terminal of the first transistor T1 is connected to the superimposing data voltage Vdata+Vth0. At this time, the first node G receives Vdata+Vth0, the voltage of the second node S remains Vref-Vth, and a voltage difference between the control terminal and the first terminal of the driving transistor DT is a voltage difference between the first node G and the second node S, which is Vgs=Vdata−Vref+Vth+Vth0, wherein Vdata is the data voltage output from the data line, and Vth0 is the initial threshold voltage of the driving transistor DT during shutdown period.

Figure 7:
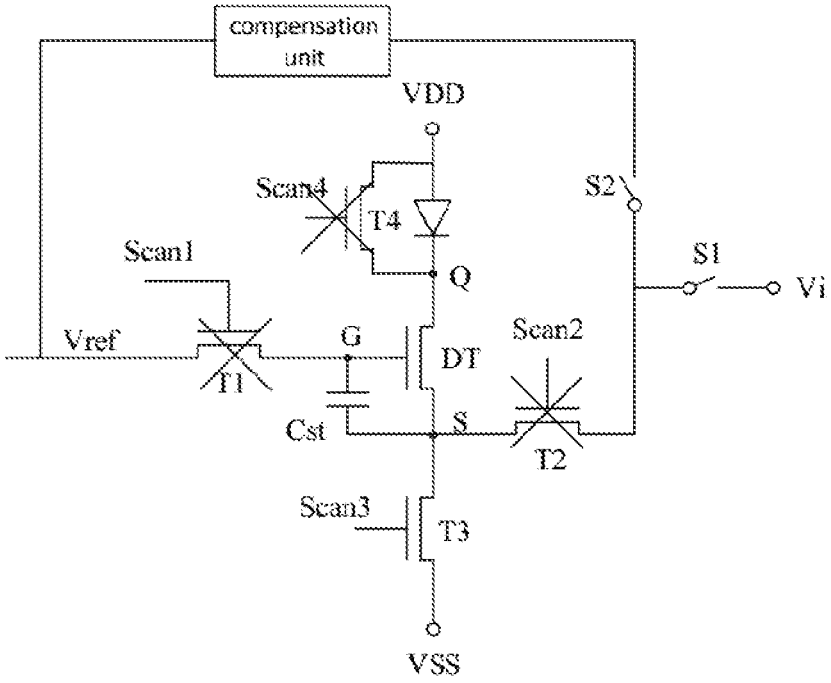
FIG. 7 is a circuit diagram of the pixel compensation driving circuit during a light-emitting phase according to one embodiment of the present disclosure.

FIG. 7 is a circuit diagram of the pixel compensation driving circuit during a light-emitting phase according to one embodiment of the present disclosure. With reference to FIGS. 3 and 7, during the light-emitting phase t4, the third scan signal Scan3 provides the high electrical potential, the first scan signal Scan1, the second scan signal Scan2, and the fourth scan signal Scan4 provide the low electrical potential, the first switch S1 and the second switch S2 are disconnected; the driving transistor DT and the third transistor T3 are turned on, and the first transistor T1, the second transistor T2, and the fourth transistor T4 are turned off, and the first terminal of the first transistor T1 is connected to the reference voltage. At the same time, the driving transistor DT drives the light-emitting element to emit light, and the current flowing through the light-emitting element is: $I=k(Vgs-Vth)^2=k(Vdata-Vref+Vth0)^2$, wherein k is the mobility of the driving transistor DT.

It can be seen that the pixel compensation driving circuit provided by the embodiments of the present disclosure can effectively compensate the actual threshold voltage Vth of the driving transistor DT instantly, and finally makes the current flowing through the light-emitting element independent from the actual threshold voltage Vth of the driving transistor DT, thereby eliminating the drift of the actual threshold voltage of the driving transistor DT which causes the uneven display of the display device, and improving a display effect of the screen. Moreover, because this kind of compensation method is an internal compensation method, the compensation speed is fast.

Specifically, in each frame time in step S3, the operation process that the pixel compensation driving circuit detects and stores a mobility of the driving transistor (DT) within each frame time according to the superimposing data voltage includes a first mobility detection phase, a second mobility detection phase, and a third mobility detection phase.

During the first mobility detection phase, the first scan signal Scan1, the second scan signal Scan2, and the third scan signal Scan3 provide the high electrical potential, and the fourth scan signal Scan4 provides the low electrical potential, the first switch S1 is closed, and the second switch S2 is open; the driving transistor DT, the first transistor T1, the second transistor T2 and the third transistor T3 are turned on, the fourth transistor T4 is turned off, the second terminal of the second transistor T2 Is connected to the initialization voltage Vi, and the first terminal of the first transistor T1 is connected to the superimposing data voltage. At the same time, the first node G receives the superimposing data voltage Vdata+Vth0, and the second node S receives the initialization voltage Vi.

During the second mobility detection phase, the second scan signal Scan2 and the third scan signal Scan3 provide the high electrical potential, the first scan signal Scan1 and the fourth scan signal Scan4 provide the low electrical potential, the first switch S1 and the second switch S2 are disconnected; the driving transistor DT, the second transistor T2, and the third transistor T3 are turned on, the first transistor T1 and the fourth transistor T4 are turned off, and the first terminal of the first transistor T1 is connected to the reference voltage Vref.

During the third mobility detection phase, the second scan signal Scan2 and the third scan signal Scan3 provide the high electrical potential, the first scan signal Scan1 and the fourth scan signal Scan4 provide the low electrical potential, the first switch S1 is open, the second switch S2 is closed, the driving transistor DT, the second transistor (T2), and the third transistor T3 are turned on, the first transistor T1 and the fourth transistor T4 are turned off, and the second terminal of the second transistor T2 is connected to the second terminal of the compensation unit, and the first terminal of the first transistor T1 is connected to the reference voltage Vref. At the same time, the compensation unit acquires the charging voltage output from the second transistor T2, and acquires and stores the mobility of the driving transistor DT according to the charging voltage.

The operation process in step S1 that the compensation unit detects and stores the initial threshold voltage of the driving transistor DT includes a first initial threshold voltage detection phase and a second initial threshold voltage detection phase.

During the first initial threshold voltage detection phase, the first scan signal Scan1, the second scan signal Scan2, and the third scan signal Scan3 provide the high electrical potential, the fourth scan signal Scan4 provide the low electrical potential, the first switch S1 is closed, the second switch S2 is open; the driving transistor DT, the first transistor T1, the second transistor T2, and the third transistor (T3) are turned on, the fourth transistor T4 is turned off, the second terminal of the second transistor T2 is connected to the initialization voltage Vi, the first terminal of the first transistor T1 is connected to the data voltage Vdata.

During the second initial threshold voltage detection phase, the first scan signal Scan1, the second scan signal Scan2, and the third scan signal Scan3 provide the high electrical potential, and the fourth scan signal Scan4 provide the low electrical potential, the first switch S1 is open, and the second switch S2 is closed; the driving transistor DT, the first transistor T1, the second transistor T2, and the third transistor T3 are turned on, the fourth transistor T4 is turned off, and the second terminal of the second transistor T2 is connected to the second terminal of the compensation unit, the first terminal of the first transistor T1 is connected to the data voltage Vdata.

One embodiment of the present disclosure further provides a display device including a pixel compensation driving circuit. As shown in FIG. 1, the pixel compensation driving circuit adopts a 5T1C structure, including: a driving transistor DT, a first transistor T1, a second transistor T2, a third transistor T3, a fourth transistor T4, a storage capacitor Cst, a light-emitting element, a first switch S1, a second switch S2, and a compensation unit.

A control terminal of the driving transistor DT is connected to a first node G, a first terminal of the driving transistor DT is connected to a second node S, and a second terminal of the driving transistor DT is connected to a third node Q. A control terminal of the first transistor T1 is connected to a first scan signal Scan1, a first terminal of the first transistor T1 is connected to a data line and a first terminal of the compensation unit, and a second terminal of the first transistor T1 is connected to the first node G. A control terminal of the second transistor T2 is connected to a second scan signal Scan2, a first terminal of the second transistor T2 is connected to the second node S, and a second terminal of the second transistor T2 is connected to a first terminal of the first switch S1 and a first terminal of the second switch S2. A control terminal of the third transistor T3 is connected to a third scan signal Scan3, a first terminal of the third transistor T3 is connected to a negative power supply voltage VSS, and a second terminal of the third transistor T3 is connected to the second node S. A control terminal of the fourth transistor T4 is connected to a fourth scan signal Scan4, a first terminal of the fourth transistor T4 is connected to the third node Q, and a second terminal of the fourth transistor T4 is connected to a positive power supply voltage VDD. A first terminal of the storage capacitor Cst is connected to the first node G and a second terminal of the storage capacitor Cst is connected to the second node S. A first terminal of the light-emitting element is connected to the positive power supply voltage VDD, and a second terminal of the light-emitting element is connected to the third node Q. A second terminal of the first switch S1 is connected to an initialization voltage Vi. A second terminal of the second switch S2 is connected to a second terminal of the compensation unit.

The compensation unit is configured to detect and store an initial threshold voltage of the driving transistor DT, so that the pixel compensation driving circuit obtains a superimposing data voltage by superimposing the initial threshold voltage and a data voltage output from the data line to compensate an actual threshold voltage of the driving transistor DT.

The pixel compensation driving circuit also detects and stores a mobility of the driving transistor DT according to the superimposing data voltage.

It should be noted that the control terminal, the first terminal, and the second terminal of the transistor in the embodiment of the present disclosure are the gate, source, and drain of the transistor, respectively, and the first terminal and the second terminal can be interchanged.

The light-emitting element is an organic light-emitting diode, the first terminal of the light-emitting element is an anode terminal, and the second terminal is a cathode terminal.

The compensation unit may include an analog-to-digital converter, a current comparator, a controller, a memory, and a digital-to-analog converter connected in sequence, an input terminal of the analog-to-digital converter is connected to the second terminal of the second switch S2, and an output terminal of the digital-to-analog converter is connected to the first terminal of the first transistor T1. The analog-to-digital converter is configured to digitize the initial threshold voltage of the driving transistor DT output from the second terminal of the second transistor T2, the memory is configured to store the digitized initial threshold voltage, and the digital-to-analog converter is configured to simulate the digitized initial threshold voltage, then input to the first terminal of the first transistor T1.

In one embodiment, the driving transistor DT, the first transistor T1, the second transistor T2, the third transistor T3, and the fourth transistor T4 are N-type thin film transistors.

In one embodiment, all the driving transistor DT, the first transistor T1, the second transistor T2, the third transistor T3, and the fourth transistor T4 are low temperature polysilicon thin film transistors, or oxide semiconductor thin film transistors, or amorphous silicon thin film transistors.

It should be noted that the driving transistor DT, the first transistor T1, the second transistor T2, the third transistor T3, and the fourth transistor T4 in the embodiment of the present disclosure all use the same type of thin film transistor to prevent a difference between different types of thin film transistors from adversely affecting the pixel compensation driving circuit.

In one embodiment, the first scan signal Scan1, the second scan signal Scan2, the third scan signal Scan3, and the fourth scan signal Scan4 are all provided by an external timing controller.

In addition, the display device may be an active-matrix organic light-emitting diode (AMOLED) display device, specifically a mobile phone, a tablet computer, a television, a display, a notebook computer, a digital photo frame, a navigator, and other display functional products or parts, etc.

It can be understood that, for those of ordinary skill in the art, equivalent replacements or changes can be made according to the technical solutions and inventive concepts of the present disclosure, and all such changes or replacements should fall within the protection scope of the appended claims of the present disclosure.

What is claimed is:

1. A pixel compensation driving circuit, comprises: a driving transistor (DT), a first transistor (T1), a second transistor (T2), a third transistor (T3), a fourth transistor (T4), a storage capacitor, a light-emitting element, a first switch (S1), a second switch (S2), and a compensation unit;

a control terminal of the driving transistor (DT) is connected to a first node (G), a first terminal of the driving transistor (DT) is connected to a second node (S), and a second terminal of the driving transistor (DT) is connected to a third node (Q);

a control terminal of the first transistor (T1) is connected to a first scan signal (Scan1), a first terminal of the first transistor (T1) is connected to a data line and a first terminal of the compensation unit, and a second terminal of the first transistor (T1) is connected to the first node (G);

a control terminal of the second transistor (T2) is connected to a second scan signal (Scan2), a first terminal of the second transistor (T2) is connected to the second node (S), and a second terminal of the second transistor (T2) is connected to a first terminal of the first switch (S1) and a first terminal of the second switch (S2);

a control terminal of the third transistor (T3) is connected to a third scan signal (Scan3), a first terminal of the third transistor (T3) is connected to a negative power supply voltage (VSS), and a second terminal of the third transistor (T3) is connected to the second node (S);

a control terminal of the fourth transistor (T4) is connected to a fourth scan signal (Scan4), a first terminal of the fourth transistor (T4) is connected to the third node (Q), and a second terminal of the fourth transistor (T4) is connected to a positive power supply voltage (VDD);

a first terminal of the storage capacitor is connected to the first node (G), and a second terminal of the storage capacitor is connected to the second node (S);

a first terminal of the light-emitting element is connected to the positive power supply voltage (VDD), and a second terminal of the light-emitting element is connected to the third node (Q);

a second terminal of the first switch (S1) is connected to an initialization voltage (Vi);

a second terminal of the second switch (S2) is connected to a second terminal of the compensation unit; and the compensation unit is configured to detect and store an initial threshold voltage of the driving transistor (DT), so that the pixel compensation driving circuit obtains a superimposing data voltage by superimposing the initial threshold voltage and a data voltage output from the data line to compensate an actual threshold voltage of the driving transistor (DT).

2. The pixel compensation driving circuit as claimed in claim 1, wherein the pixel compensation driving circuit further configured to detect and store a mobility of the driving transistor (DT) according to the superimposing data voltage.

3. The pixel compensation driving circuit as claimed in claim 1, wherein the driving transistor (DT), the first transistor (T1), the second transistor (T2), the third transistor (T3), and the fourth transistor (T4) are N-type thin film transistors.

4. The pixel compensation driving circuit as claimed in claim 1, wherein the driving transistor (DT), the first transistor (T1), the second transistor (T2), the third transistor (T3), and the fourth transistor (T4) are low temperature polysilicon thin film transistors, or oxide semiconductor thin film transistors, or amorphous silicon thin film transistors.

5. The pixel compensation driving circuit as claimed in claim 1, wherein the light-emitting element is an organic light-emitting diode.

6. The pixel compensation driving circuit as claimed in claim 1, wherein the first terminal of the light-emitting element is an anode terminal, and the second terminal of the light-emitting element is a cathode terminal.

7. The pixel compensation driving circuit as claimed in claim 1, wherein the first scan signal (Scan1), the second scan signal (Scan2), the third scan signal (Scan3), and the fourth scan signal (Scan4) are provided by a timing controller.

8. A pixel compensation driving method for driving a pixel compensation driving circuit, wherein the pixel compensation driving circuit comprises a driving transistor (DT), a first transistor (T1), a second transistor (T2), a third transistor (T3), a fourth transistor (T4), a storage capacitor, a light-emitting element, a first switch (S1), a second switch (S2), and a compensation unit;

a control terminal of the driving transistor (DT) is connected to a first node (G), a first terminal of the driving transistor (DT) is connected to a second node (S), and a second terminal of the driving transistor (DT) is connected to a third node (Q);

a control terminal of the first transistor (T1) is connected to a first scan signal (Scan1), a first terminal of the first transistor (T1) is connected to a data line and a first terminal of the compensation unit, and a second terminal of the first transistor (T1) is connected to the first node (G);

a control terminal of the second transistor (T2) is connected to a second scan signal (Scan2), a first terminal of the second transistor (T2) is connected to the second node (S), and a second terminal of the second transistor (T2) is connected to a first terminal of the first switch (S1) and a first terminal of the second switch (S2);

a control terminal of the third transistor (T3) is connected to a third scan signal (Scan3), a first terminal of the third transistor (T3) is connected to a negative power supply voltage (VSS), and a second terminal of the third transistor (T3) is connected to the second node (S);

a control terminal of the fourth transistor (T4) is connected to a fourth scan signal (Scan4), a first terminal of the fourth transistor (T4) is connected to the third node (Q), and a second terminal of the fourth transistor (T4) is connected to a positive power supply voltage (VDD);

a first terminal of the storage capacitor is connected to the first node (G), and a second terminal of the storage capacitor is connected to the second node (S);

a first terminal of the light-emitting element is connected to the positive power supply voltage (VDD), and a second terminal of the light-emitting element is connected to the third node (Q);

a second terminal of the first switch (S1) is connected to an initialization voltage (Vi);

a second terminal of the second switch (S2) is connected to a second terminal of the compensation unit; and the compensation unit is configured to detect and store an initial threshold voltage of the driving transistor (DT), so that the pixel compensation driving circuit obtains a superimposing data voltage by superimposing the initial threshold voltage and a data voltage output from the data line to compensate an actual threshold voltage of the driving transistor (DT); and wherein the pixel compensation driving method comprising following steps:

step S1, during shutdown period, the compensation unit detecting and storing the initial threshold voltage of the driving transistor (DT); and step S2, during power-on period, the pixel compensation driving circuit obtains the superimposing data voltage by superimposing the initial threshold voltage and the data voltage output from the data line, to compensate the actual threshold voltage of the driving transistor (DT) within each frame time.

9. The pixel compensation driving method as claimed in claim 8, wherein after the step S2, the pixel compensation driving method further comprises:

step S3, during the power-on period, the pixel compensation driving circuit is configured to detect and store a mobility of the driving transistor (DT) within each frame time according to the superimposing data voltage.

10. The pixel compensation driving method as claimed in claim 8, wherein the step S2 further comprises a reset phase, a detection phase, a voltage writing phase, and a light-emitting phase;

during the reset phase, the first scan signal (Scan1), the second scan signal (Scan2), and the fourth scan signal (Scan4) provide a high electrical potential, the third scan signal (Scan3) provides a low electrical potential, the first switch (S1) is closed, the second switch (S2) is open, the driving transistor (DT), the first transistor (T1), the second transistor (T2), and the fourth transistor (T4) are turned on, the third transistor (T3) is turned off, the second terminal of the second transistor (T2) is connected to the initialization voltage (Vi), and the first terminal of the first transistor (T1) is connected to a reference voltage;

during the detection phase, the first scan signal (Scan1) and the fourth scan signal (Scan4) provide the high electrical potential, the second scan signal (Scan2) and third scan signal (Scan3) provide the low electrical potential, the first switch (S1) and the second switch (S2) are open, the driving transistor (DT), the first transistor (T1), and the fourth transistor (T4) are turned on, the second transistor (T2) and the third transistor (T3) are turned off, and the first terminal of the first transistor (T1) is connected to the reference voltage;

during the voltage writing phase, the first scan signal (Scan1) and the third scan signal (Scan3) provide the high electrical potential, and the second scan signal (Scan2) and the fourth scan signal (Scan4) provide the low electrical potential, the first switch (S1) and the second switch (S2) are open, the driving transistor (DT), the first transistor (T1), and the third transistor (T3) are turned on, the second transistor (T2) and the fourth transistor (T4) are turned off, and the first terminal of the first transistor (T1) is connected to the superimposing data voltage; and during the light-emitting phase, the third scan signal (Scan3) provides the high electrical potential, the first scan signal (Scan1), the second scan signal (Scan2), and the fourth scan signal (Scan4) provide the low electrical potential, the first switch (S1) and the second switch (S2) are open, the driving transistor (DT) and the third transistor (T3) are turned on, and the first transistor (T1), the second transistor (T2) and the fourth transistor (T4) are turned off, and the first terminal of the first transistor (T1) is connected to the reference voltage.

11. The pixel compensation driving method as claimed in claim 9, wherein the step S3 further comprises a first mobility detection phase, a second mobility detection phase, and a third mobility detection phase;

during the first mobility detection phase, the first scan signal (Scan1), the second scan signal (Scan2) and the third scan signal (Scan3) provide a high electrical potential, the fourth scan signal (Scan4) provides a low electrical potential, the first switch (S1) is closed, the second switch (S2) is open, the driving transistor (DT), the first transistor (T1), the second transistor (T2) and the third transistor (T3) are turned on, the fourth transistor (T4) is turned off, the second terminal of the second transistor (T2) is connected to the initialization voltage (Vi), and the first terminal of the first transistor (T1) is connected to the superimposing data voltage;

during the second mobility detection phase, the second scan signal (Scan2) and the third scan signal (Scan3) provide the high electrical potential, the first scan signal (Scan1) and the fourth scan signal (Scan4) provide the low electrical potential, the first switch (S1) and the second switch (S2) are open, the driving transistor (DT), the second transistor (T2), and the third transistor (T3) are turned on, the first transistor (T1) and the fourth transistor (T4) are turned off, and the first terminal of the first transistor (T1) is connected to a reference voltage; and during the third mobility detection phase, the second scan signal (Scan2) and the third scan signal (Scan3) provide the high electrical potential, the first scan signal (Scan1) and the fourth scan signal (Scan4) provide the low electrical potential, the first switch (S1) is open, the second switch (S2) is closed, the driving transistor (DT), the second transistor (T2), and the third transistor (T3) are turned on, the first transistor (T1) and the fourth transistor (T4) are turned off, the second terminal of the second transistor (T2) is connected to the second terminal of the compensation unit, and the first terminal of the first transistor (T1) is connected to the reference voltage.

12. The pixel compensation driving method as claimed in claim 8, wherein the step S1 comprises a first initial threshold voltage detection phase and a second initial threshold voltage detection phase;

during the first initial threshold voltage detection phase, the first scan signal (Scan1), the second scan signal (Scan2), and the third scan signal (Scan3) provide a high electrical potential, the fourth scan signal (Scan4) provide a low electrical potential, the first switch (S1) is closed, the second switch (S2) is open, the driving transistor (DT), the first transistor (T1), the second transistor (T2), and the third transistor (T3) are turned on, the fourth transistor (T4) is turned off, the second terminal of the second transistor (T2) is connected to the initialization voltage (Vi), and the first terminal of the first transistor (T1) is connected to the data voltage; and during the second initial threshold voltage detection phase, the first scan signal (Scan1), the second scan signal (Scan2), and the third scan signal (Scan3) provide the high electrical potential, the fourth scan signal (Scan4) provide the low electrical potential, the first switch (S1) is open, the second switch (S2) is closed, the driving transistor (DT), the first transistor (T1), the second transistor (T2) and the third transistor (T3) are turned on, the fourth transistor (T4) is turned off, the second terminal of the second transistor (T2) is connected to the second terminal of the compensation unit, and the first terminal of the first transistor (T1) is connected to the data voltage.

13. A display device, comprising a pixel compensation driving circuit, wherein the pixel compensation driving circuit comprises a driving transistor (DT), a first transistor (T1), a second transistor (T2), a third transistor (T3), a fourth transistor (T4), a storage capacitor, alight-emitting element, a first switch (S1), a second switch (S2), and a compensation unit;

a control terminal of the driving transistor (DT) is connected to a first node (G), a first terminal of the driving transistor (DT) is connected to a second node (S), and a second terminal of the driving transistor (DT) is connected to a third node (Q);

a control terminal of the first transistor (T1) is connected to a first scan signal (Scan1), a first terminal of the first transistor (T1) is connected to a data line and a first terminal of the compensation unit, and a second terminal of the first transistor (T1) is connected to the first node (G);

a control terminal of the second transistor (T2) is connected to a second scan signal (Scan2), a first terminal of the second transistor (T2) is connected to the second node (S), and a second terminal of the second transistor (T2) is connected to a first terminal of the first switch (S1) and a first terminal of the second switch (S2);

a control terminal of the third transistor (T3) is connected to a third scan signal (Scan3), a first terminal of the third transistor (T3) is connected to a negative power supply voltage (VSS), and a second terminal of the third transistor (T3) is connected to the second node (S);

a control terminal of the fourth transistor (T4) is connected to a fourth scan signal (Scan4), a first terminal of the fourth transistor (T4) is connected to the third node (Q), and a second terminal of the fourth transistor (T4) is connected to a positive power supply voltage (VDD);

a first terminal of the storage capacitor is connected to the first node (G), and a second terminal of the storage capacitor is connected to the second node (S);

a first terminal of the light-emitting element is connected to the positive power supply voltage (VDD), and a second terminal of the light-emitting element is connected to the third node (Q);

a second terminal of the first switch (S1) is connected to an initialization voltage (Vi);

a second terminal of the second switch (S2) is connected to a second terminal of the compensation unit; and the compensation unit is configured to detect and store an initial threshold voltage of the driving transistor (DT), so that the pixel compensation driving circuit obtains a superimposing data voltage by superimposing the initial threshold voltage and a data voltage output from the data line to compensate an actual threshold voltage of the driving transistor (DT).

14. The display device as claimed in claim 13, wherein the pixel compensation driving circuit further detects and stores a mobility of the driving transistor (DT) according to the superimposing data voltage.

15. The display device as claimed in claim 13, wherein the driving transistor (DT), the first transistor (T1), the second transistor (T2), the third transistor (T3), and the fourth transistor (T4) are N-type thin film transistors.

16. The display device as claimed in claim 13, wherein all the driving transistor (DT), the first transistor (T1), the second transistor (T2), the third transistor (T3), and the fourth transistor (T4) are low temperature polysilicon thin film transistors, oxide semiconductor thin film transistors, or amorphous silicon thin film transistors.

17. The display device as claimed in claim 13, wherein the light-emitting element is an organic light-emitting diode.

18. The display device as claimed in claim 13, wherein the first terminal of the light-emitting element is an anode terminal, and the second terminal of the light-emitting element is a cathode terminal.

19. The display device as claimed in claim 13, wherein the first scan signal (Scan1), the second scan signal (Scan2), the third scan signal (Scan3), and the fourth scan signal (Scan4) are provided by a timing controller.

20. The display device as claimed in claim 13, wherein the display device is an active matrix organic light-emitting diode display device.

* * * * *